US006702015B2

(12) United States Patent
Fielder, III et al.

(10) Patent No.: US 6,702,015 B2
(45) Date of Patent: Mar. 9, 2004

(54) METHOD AND APPARATUS FOR DEPLOYING POWER CABLE AND CAPILLARY TUBE THROUGH A WELLBORE TOOL

(75) Inventors: Robert P. Fielder, III, Quito (EC); Timothy W. Collen, Quito (EC); Massimiliano Pozzoni, Milan (IT)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/041,365

(22) Filed: Jan. 8, 2002

(65) Prior Publication Data

US 2002/0088623 A1 Jul. 11, 2002

Related U.S. Application Data

(60) Provisional application No. 60/260,416, filed on Jan. 9, 2001.

(51) Int. Cl.[7] ..... E21B 33/12

(52) U.S. Cl. ..... 166/133; 166/126; 166/131; 166/183; 166/185; 166/65.1

(58) Field of Search ..... 166/241.1, 241.5, 166/241.6, 65.1, 126, 131, 133, 183, 185

(56) References Cited

U.S. PATENT DOCUMENTS

| | | | | |
|---|---|---|---|---|
| 3,734,179 A | * | 5/1973 | Smedley | 166/106 |
| 3,926,269 A | * | 12/1975 | Cullen et al. | 175/104 |
| 4,387,767 A | * | 6/1983 | Read | 166/72 |
| 4,583,804 A | | 4/1986 | Thompson | |
| 4,621,689 A | | 11/1986 | Brookbank, III | |
| 4,627,490 A | | 12/1986 | Moore | |
| 4,727,223 A | | 2/1988 | Lee et al. | |
| 4,798,243 A | * | 1/1989 | Curington et al. | 166/65.1 |
| 4,854,886 A | | 8/1989 | Neuroth | |
| 5,051,103 A | | 9/1991 | Neuroth | |
| 6,026,897 A | * | 2/2000 | Pringle et al. | 166/65.1 |

FOREIGN PATENT DOCUMENTS

GB 2 371 062 A 7/2002

* cited by examiner

*Primary Examiner*—David Bagnell
*Assistant Examiner*—G M Collins
(74) *Attorney, Agent, or Firm*—Robert A. Van Someren; Jeffrey Griffin; Brigitte Echols

(57) ABSTRACT

A technique to facilitate deployment of power cable and at least one capillary tube through a wellbore tool, such as a packer. The technique allows both the power cable and the at least one capillary tube to extend through a single pass-through opening in the wellbore tool.

26 Claims, 3 Drawing Sheets

METHOD AND APPARATUS FOR DEPLOYING POWER CABLE AND CAPILLARY TUBE THROUGH A WELLBORE TOOL

CROSS REFERENCE TO RELATED APPLICATIONS

The following is based on and claims the priority of provisional application No. 60/260,416 filed Jan. 9, 2001.

FIELD OF THE INVENTION

This invention generally relates to penetrators. Specifically, this invention relates to penetrators that enable the passage of a bundled electric submersible pumping (ESP) cable and at least one capillary tube through a single hole defined in a wellbore tool, such as a packer.

BACKGROUND OF THE INVENTION

It is fairly common for downhole completions to include multiple capillary lines as well as ESP cables. These capillary lines and ESP cables must pass through wellbore tools, e.g. packers, that are also part of the completion. Prior art packers typically include only one pass-through bore, which pass-through bore receives the ESP cable (and not the capillary tubes). Thus, it is normally necessary to form additional pass-through bores through a packer during the manufacturing process to enable the pass-through of the capillary lines. Such additional bores typically require threads at the top end (and possibly the bottom end) to accommodate pressure fittings to create a pressure seal.

However, depending on the packer type and size, the production tubing dimensions, and the number of ESP and capillary tube penetrations required, accommodating these additional bores can be a challenge due to space constraints. The bores also can affect the residual strength of the packer.

It would be beneficial to provide a solution that enables the pass-through of at least one ESP cable as well as at least one capillary tube through a packer or other tool without having to include additional bores in the tool. It would also be beneficial to provide such a solution that utilizes standard packer and packer penetrator designs.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

Figure 1:
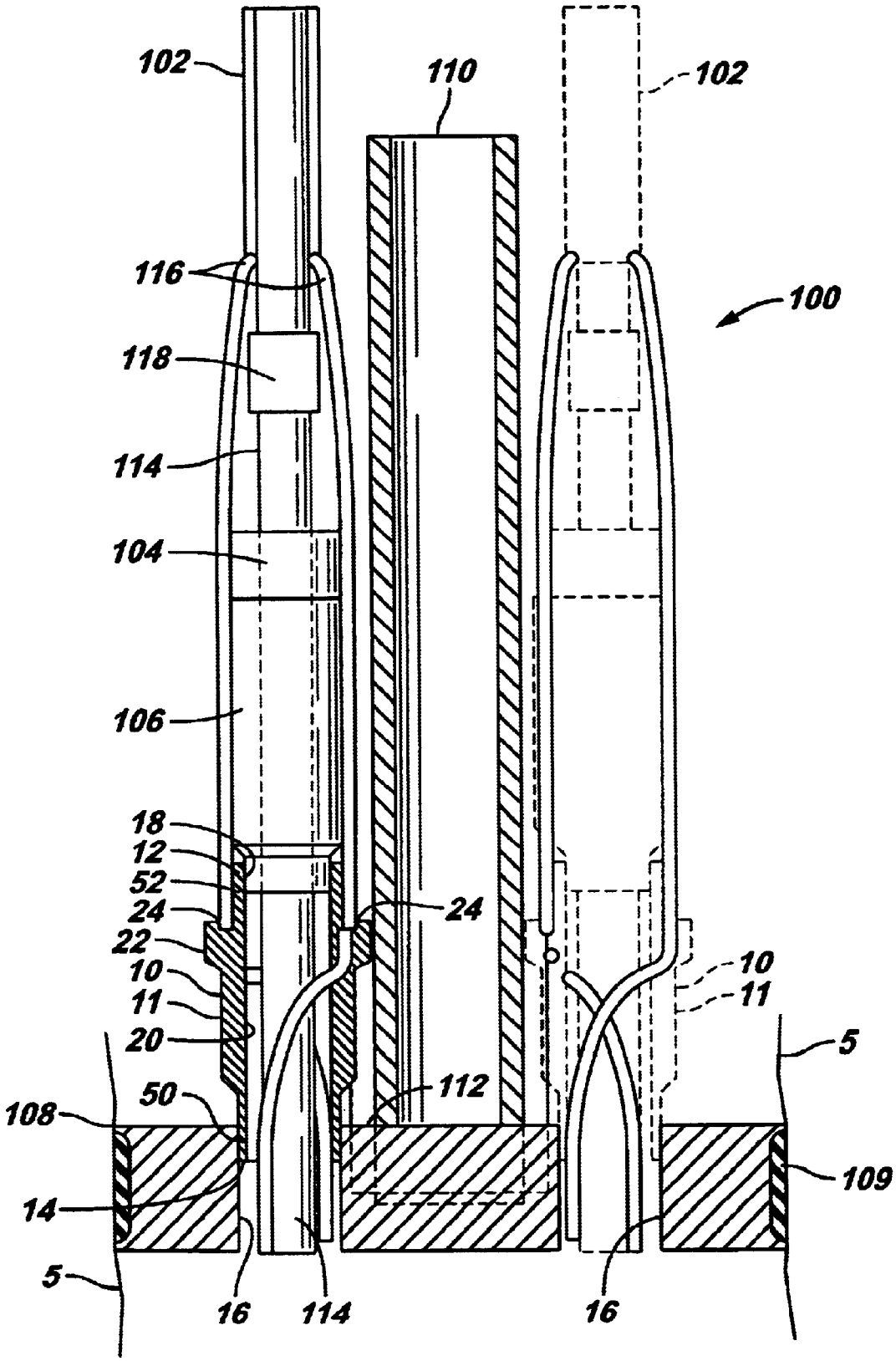
FIG. 1 is a longitudinal cross-sectional view of the adapter of this invention.

Referring generally to FIG. 1, an assembly 100 comprises a bundled cable 102, a packer 108, a tubing 110, e.g. production tubing, and an adapter 10. Packer 108 typically is sealed against a wellbore 5, which may or may not be cased, by an appropriate seal 109. Tubing 110 is connected to the packer bore 112 and is adapted to receive fluid flow therethrough.

The bundled cable 102 may be an ESP cable that comprises a power cable for extending to and powering an electric submersible pump (not shown). To reach the pump, the ESP cable 102 passes through packer 108. In prior art designs, a similar bundled ESP cable is spliced by a field splice, the spliced ESP flat cable is inserted through a packer penetrator, the penetrator is connected to a crossover, and the crossover is directly connected to the packer pass-through bore. The ESP flat cable thus extends through the penetrator and through the packer pass-through bore to the downhole pump.

Figure 2:
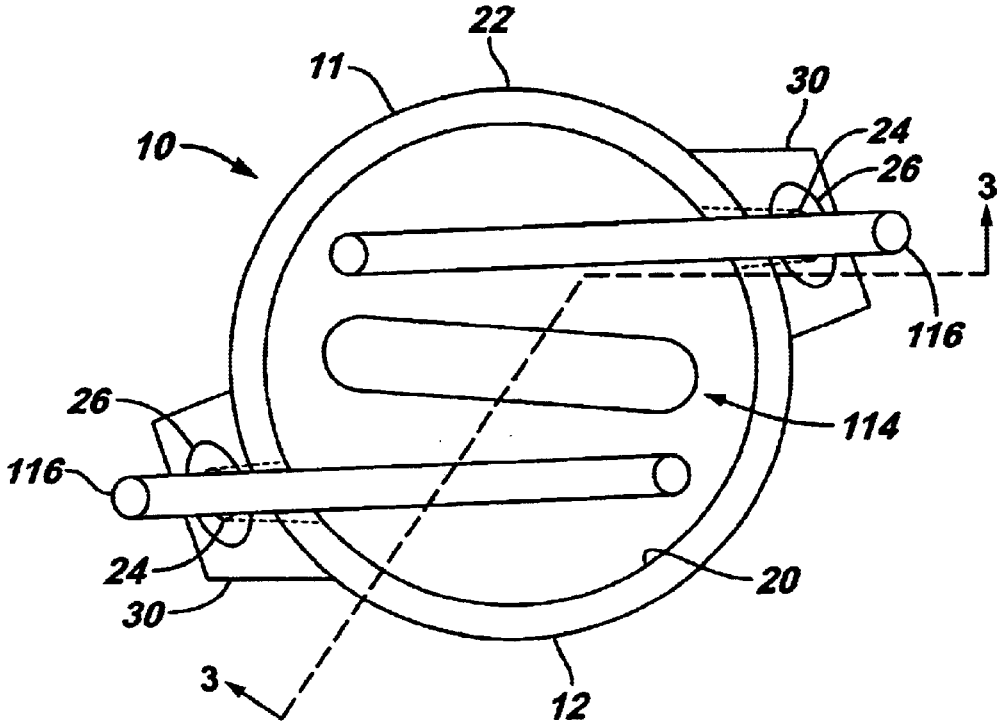
FIG. 2 is a top view of the adapter, including the capillary tubes and fittings.
Figure 4:
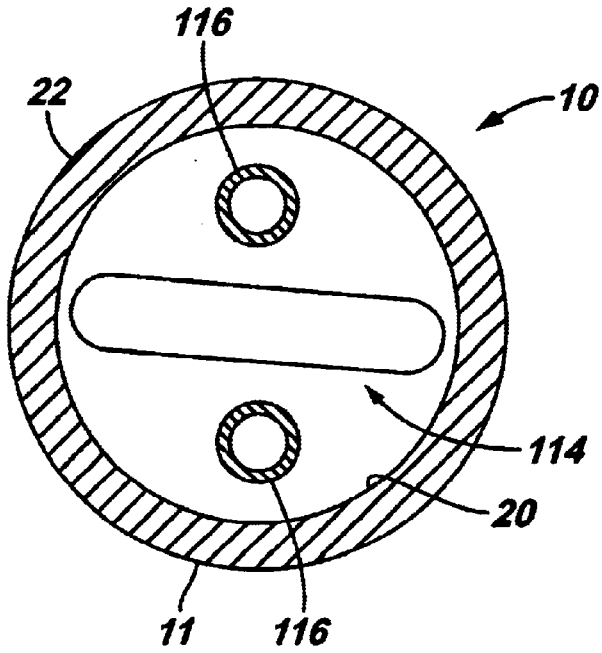
FIG. 4 is a cross-sectional view taken along line 4—4 of FIG. 3.
Figure 3:
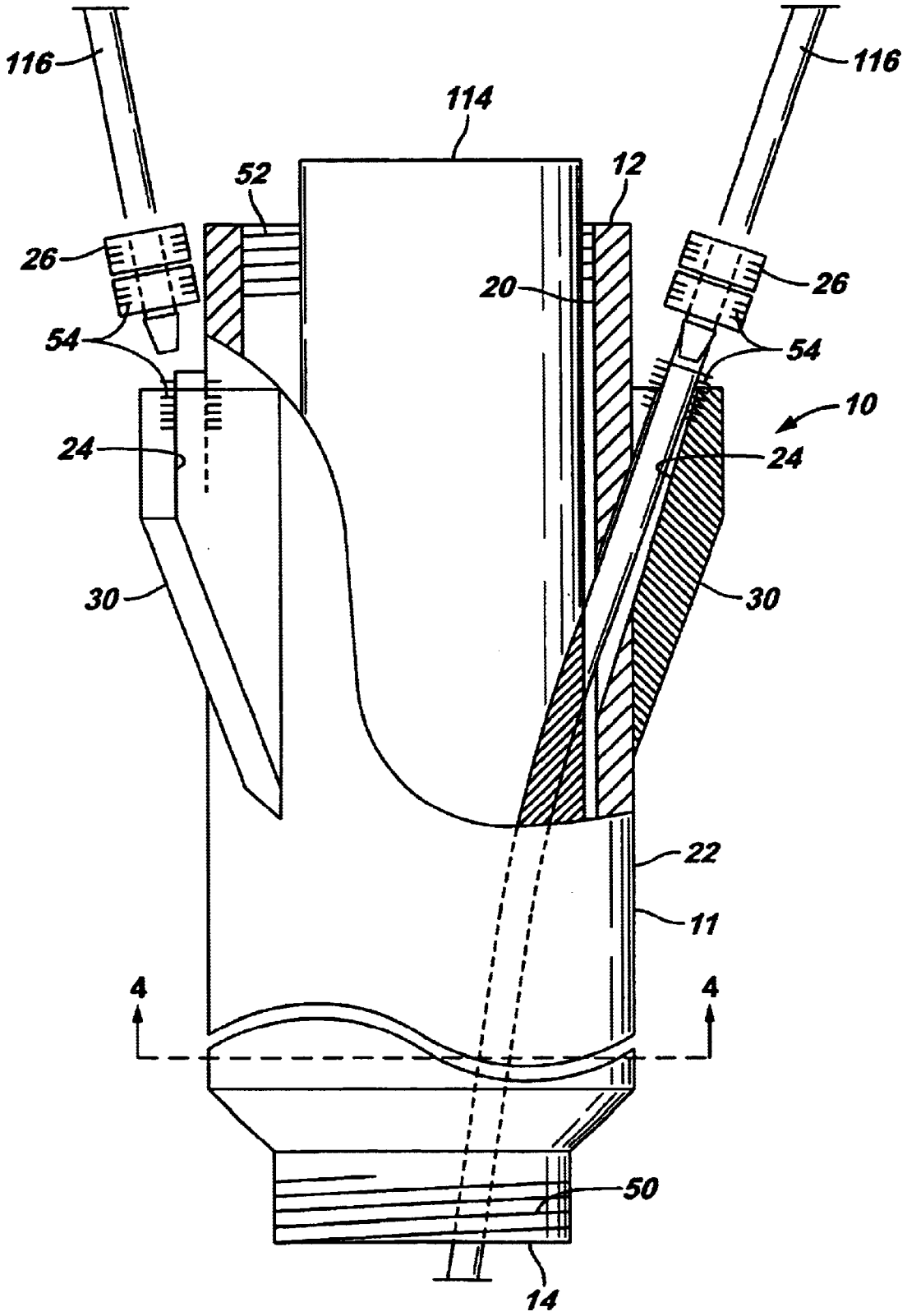
FIG. 3 is a cross-sectional view taken along line 3—3 of FIG. 2.

As illustrated in FIGS. 2 through 4, the bundled ESP cable 102 comprises, for example, an ESP flat cable 114 and one or more capillary tubes 116. In FIG. 2, the bundled ESP cable 102 comprises two capillary tubes 116. Generally, capillary tubes 116 are used to inject chemicals/fluid, to take bottom hole samples, or to vent trapped gas from downhole to surface.

A field splice 118 unbundles the ESP cable 102 into the flat cable 114 and the capillary tube(s) 116. The flat cable 114 is then inserted through a packer penetrator 104, which penetrator is attached to a crossover 106. However, unlike the prior art design in which the crossover is directly attached to the packer, the crossover 106 in this design is attached to a top end 12 of the adapter 10. A bottom end 14 of the adapter 10 is then connected to a packer pass-through bore 16.

The ESP flat cable 114 passes through the penetrator 104 and crossover 106, through the adapter 10 (as will be described herein), and through the packer pass-through bore 16. The capillary tube(s) 116 pass outside of the penetrator 104 and crossover 106, into the interior of the adapter 10 (as will be described herein), and through the packer pass-through bore 16.

Adapter 10 includes a body 11 and is constructed from a material that is compatible with the packer 108, penetrator 104, and crossover 106, such as steel or stainless steel. The adapter bottom end 14 is sealingly engaged, such as by mating threads 50, to the packer pass-through bore 16. Moreover, the adapter top end 12 also is sealingly engaged, such as by mating threads 52, to the bottom end 18 of the crossover 106 (see FIGS. 1 and 3). As is known in the art, the ESP flat cable 114 is sealingly engaged to the penetrator 104.

Adapter 10 comprises an exterior surface 22 and a passageway 20 extending through the adapter 10. Passageway 20 receives the ESP flat cable 114 and the capillary tube(s) 116 and enables their extension through the packer pass-through bore 16. Adapter 10 further comprises at least one capillary hole 24 extending from the exterior surface 22 to the passageway 20 thereby providing communication between the exterior and the interior of the adapter 10. Each capillary hole 24 enables the connection of or the passage of a capillary tube 116 from the exterior of the adapter 10 to the passageway 20. Thus, the number of capillary tube(s) 116 generally matches the number of capillary holes 24. As shown in the Figures, e.g. FIGS. 2 and 3, the capillary hole(s) 24 may be disposed through wing elements 30 located on the adapter exterior surface 22. In the embodiment shown in the Figures, each wing element 30 has one capillary hole 24. In other embodiments (not shown), more than one capillary hole 24 may be included on a wing element 30.

As best seen in FIG. 3, a fitting 26 is sealingly engaged, such as by mating threads 54, to each capillary hole 24. Thus, as is known in the art, each fitting 26 is sealingly engaged to the adapter 10 (at the capillary hole 24), and the capillary tube 116 is sealingly engaged to the corresponding fitting 26. It is noted that, for purposes of clarity, FIG. 3 shows the fittings 26 exploded from the capillary hole(s) 24. It is understood that in assembled form each fitting sealingly engages its corresponding capillary hole.

Thus, the ESP flat cable 114 which extends from the crossover 106 passes through the passageway 20 of the adapter 10 and through the packer pass-through bore 16. The capillary tube(s) 116 extend from the bundled ESP cable 102, exterior to the penetrator 104 and crossover 106, into and through the capillary hole(s) 24, through the passageway 20, and though the packer pass-through bore 16. Below the crossover 106, capillary tube(s) 116 are guided alongside the ESP flat cable 114 (see also FIG. 4). The sealing engagements between the ESP flat cable 114 and the penetrator 104, the crossover 106 and the adapter 10, the adapter 10 and the packer pass-through bore 16, the capillary tube(s) 116 and the fitting(s) 26, and the fitting(s) 26 and the capillary hole(s) 24 all ensure that a pressure seal exists between the upperside and underside of the packer 108.

Adapter 10 may be used with either single, dual or other multi-bore tools, such as packers. Moreover, as shown in FIG. 1, more than one adapter 10 and ESP cable 102 may be used for each packer 108 (more than one ESP cable 102 is passed through the packer 108), in which case the packer 108 would have an equal number of packer pass-through bores 16. In addition, although the adapter 10 has been described to enable the feedthrough of an ESP cable 102 and capillary tube(s) 116 through a packer 108, it is understood that the adapter 10 may be utilized to enable the feedthrough of an ESP cable 102 and capillary tube(s) 116 through other tools (not only a packer).

Thus, the adapter 10 and assembly 100 enables the feedthrough of ESP cable 102 and at least one capillary tube 116 without the need to include additional bores in the packer 108. Moreover, adapter 10 can be used with standard industry packers 108, penetrators 104, and crossovers 106. Therefore, the use of adapter 10 does not require additional investment or design modification.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A wellbore system, comprising:

a wellbore tool having a pass-through opening;

an adapter having a bundled cable passageway oriented for communication with the pass-through opening when the adapter is coupled to the wellbore tool, the adapter further comprising a capillary passage extending from an external surface of the adapter to the bundled cable passageway;

a bundled cable disposed through the pass-through opening and the bundled cable passageway; and a capillary tube disposed through the pass-through opening and the bundled cable passageway.

2. The system as recited in claim 1, wherein the tool comprises a packer.

3. The system as recited in claim 2, wherein the pass-through opening has a threaded region to which the adapter is threadably engaged.

4. The system as recited in claim 3, further comprising a crossover coupled to the adapter.

5. The system as recited in claim 4, wherein a top end of the adapter comprises a top threaded region to which the crossover is threadably engaged.

6. The system as recited in claim 1, further comprising a crossover coupled to the adapter.

7. A system for facilitating deployment of a bundled cable and at least one capillary tube to a desired wellbore location, comprising:

a bundled cable;

a wellbore tool having a pass-through opening; and an adapter having a bundled cable passageway for receiving the bundled cable, the bundled cable passageway being oriented for communication with the pass-through opening when the adapter is coupled to the wellbore tool, the adapter further comprising a capillary passage extending from an external surface of the adapter to the bundled cable passageway, wherein the adapter comprises a body and at least one wing element extending outwardly from the body, the at least one wing element having a capillary opening in communication with the capillary passage.

8. The system as recited in claim 7, further comprising a fitting by which the at least one capillary tube may be sealingly engaged with the capillary opening.

9. A system for use in a wellbore, comprising, a packer having a pass-through opening;

a crossover;

an adapter disposed between and coupled to the packer and the crossover;

a bundled cable routed through the crossover, the adapter and the pass-through opening; and a capillary tube disposed to route a fluid around the crossover and through the pass-through opening.

10. The system as recited in claim 9, wherein the adapter comprises a capillary passage to which the capillary tube is coupled, the capillary passage extending from an exterior of the adapter to an interior adapter passageway.

11. The system as recited in claim 10, wherein the pass-through opening has a threaded region to which the adapter is threadably engaged.

12. The system as recited in claim 11, wherein a top end of the adapter comprises a top threaded region to which the crossover is threadably engaged.

13. A system for use in a wellbore, comprising, a packer having a pass-through opening;

a crossover;

an adapter disposed between and coupled to the packer and the crossover;

a bundled cable routed through the crossover, the adapter and the pass-through opening; and a capillary tube disposed to route a fluid around the crossover and through the pass-through opening, wherein the adapter comprises a body and at least one wing element extending outwardly from the body, the at least one wing element having a capillary opening in communication with the capillary passage.

14. The system as recited in claim 13, further comprising a fitting by which the capillary tube may be sealingly engaged with the capillary opening.

15. A system for permitting the passage of a power cable and at least one capillary tube through a single passageway formed in wellbore tool, comprising:

at least one capillary tube: and an adapter having an exterior, a coupling region for connection to the wellbore tool and an interior defined at least in part by a bundled cable passageway, the adapter further having at least one capillary passage designed for coupling with the at least one capillary tube, wherein the at least one capillary passage extends from the exterior to the interior, wherein the adapter comprises a body and at least one wing element extending outwardly from the body, the at least one wing element having a capillary opening in communication with the capillary passage.

16. The system as recited in claim 15, further comprising a fitting by which the at least one capillary tube may be sealingly engaged with the capillary opening.

17. A method for routing a bundled cable and a capillary tube through a single passage of wellbore tool, comprising:

forming a bundled cable passage through an adapter;

coupling the adapter to the wellbore tool such that the bundled cable passage is in communication with the single passage of the wellbore tool;

creating a lateral passage from an exterior of the adapter to the bundled cable passage; and routing a capillary tube through the lateral passage and the single passage of the wellbore tool.

18. The method as recited in claim 17, further comprising routing a bundled cable through the passage.

19. The method as recited in claim 18, wherein routing comprises routing an ESP power cable.

20. The method as recited in claim 18, further comprising coupling the capillary tube to the adapter at the lateral passage.

21. The method as recited in claim 20, further comprising connecting a crossover to the adapter such that the adapter is between the crossover and the wellbore tool.

22. The method as recited in claim 21, further comprising coupling a penetrator to the crossover.

23. The method as recited in claim 22, wherein routing comprises routing the power cable internally through the crossover and the penetrator.

24. The method as recited in claim 23, further comprising locating the capillary tube external to the crossover and the penetrator.

25. The method as recited in claim 24, wherein coupling comprises coupling the adapter to the packer.

26. The method as recited in claim 25, wherein coupling comprises threadably coupling.

* * * * *